US005261611A

United States Patent [19]

Huxford

[11] Patent Number: 5,261,611

[45] Date of Patent: Nov. 16, 1993

[54] METAL ATOMIZATION SPRAY NOZZLE

[75] Inventor: Theodore J. Huxford, Harriman, Tenn.

[73] Assignee: Martin Marietta Energy Systems, Inc., Oak Ridge, Tenn.

[21] Appl. No.: 914,464

[22] Filed: Jul. 17, 1992

[51] Int. Cl.[5] ..... B05B 1/24; B05B 5/02

[52] U.S. Cl. ..... 239/690; 239/85; 75/10.65; 222/594

[58] Field of Search ..... 239/79, 81, 82, 690, 239/708, 85; 118/300; 427/422; 266/236, 237, 275; 75/10.65; 222/593, 591, 594

[56] References Cited

U.S. PATENT DOCUMENTS

| | | | |
|---|---|---|---|
| 3,463,365 | 8/1969 | Dumont-Fillon | 222/591 |
| 4,324,266 | 4/1982 | Garnier et al. | 222/594 |
| 4,612,045 | 9/1986 | Shintaku | 239/79 |
| 4,619,845 | 10/1986 | Ayers et al. | 239/79 |
| 4,645,534 | 2/1987 | D'Angelo et al. | 266/236 |
| 4,919,335 | 4/1990 | Hobson et al. . | |
| 4,925,103 | 5/1990 | Muench et al. | 239/79 |
| 5,004,153 | 4/1991 | Sawyer | 239/82 |
| 5,074,532 | 12/1991 | Ducrocq et al. | 266/237 |
| 5,201,359 | 4/1993 | McMullen | 222/593 |

FOREIGN PATENT DOCUMENTS

| | | | |
|---|---|---|---|
| 2603210 | 3/1988 | France | 239/82 |
| 268559 | 11/1988 | Japan | 222/593 |
| 1681974 | 10/1991 | U.S.S.R. | 239/81 |

*Primary Examiner*—Andres Kashnikow
*Assistant Examiner*—Christopher G. Trainor
*Attorney, Agent, or Firm*—Edward A. Pennington; Joseph A. Marasco; Harold W. Adams

[57] ABSTRACT

A spray nozzle for a magnetohydrodynamic atomization apparatus has a feed passage for molten metal and a pair of spray electrodes mounted in the feed passage. The electrodes, diverging surfaces which define a nozzle throat and diverge at an acute angle from the throat. Current passes through molten metal when fed through the throat which creates the Lorentz force necessary to provide atomization of the molten metal.

20 Claims, 3 Drawing Sheets

METAL ATOMIZATION SPRAY NOZZLE

This invention was made with government support under contract DE-AC05-840R21400 awarded by the U.S. Department of Energy to Martin Marietta Energy Systems, Inc. and the government has certain rights in this invention.

FIELD OF INVENTION

The present invention relates to an improved spray nozzle for dispersing molten metals into fine particle droplets and, more particularly, to a nozzle used in magnetohydrodynamic (MHD) atomization systems.

BACKGROUND OF THE INVENTION

Spray forming is a near-net-shape casting technology based on the atomization of a liquid stream and subsequent deposition on a substrate. Rapid solidification occurs during the spray forming process, resulting in the beneficial effects of a refined microstructure and compositional homogeneity. The process is suitable for a wide range of metallic and non-metallic materials, including low-carbon steel.

One type of spray forming technique employs gas impingement as an atomization-inducing force. Another type of spray forming avoids gas impingement by relying on the creation of a Lorentz force for atomization. The Lorentz force is created by simultaneous passing the magnetic field and an electric current through a fluid in order to create a magnetohydrodynamic (MHD) force. An apparatus and MHD spraying process is described in U.S. Pat. No. 4,919,335 to Hobson et al, which is incorporated herein by reference. The disclosure of the aforesaid patent describes a process in which an electric current is applied through molten metal while, simultaneously, a magnetic field is applied to the molten metal in a plane perpendicular to the electric current. The molten metal forms into droplets which flow in a direction perpendicular to both the electric current and the magnetic field. A nozzle described in U.S. Pat. No. 4,919,335 includes two hollow tubes which converge at a gap. Electrodes of a D.C. power source are coupled respectively to the two tubes so that a D.C. current flows through the gap when molten metal flows from the two tubes into the gap. Magnetic poles are placed in front of and behind the gap to create a magnetic field perpendicular to the direction of the electric current.

While the aforementioned nozzle is capable of effective operation in a MHD atomization spray forming operation, the electrodes are open so that metering of the molten material is difficult. If the flow of molten material poured between the two electrodes is excessive, compared to the flow capacity of the atomization electrodes, overflow of the molten metal occurs, thus seriously damaging the surrounding ancillary components. On the other hand, if the tundish flow is insufficient, intermittent and unsteady atomization will take place.

Another draw back to the aforementioned nozzle is that it has no preheating mechanism. Operation with high melting point metals, i.e., steel, requires careful attention to preheating of the spray electrodes above the melting point of the material to be atomized without overheating of close-proximity component such as the magnet and induction coils. Thus, a need exists for an improved nozzle for use in a MHD spraying process.

SUMMARY OF THE INVENTION

An object of the present invention is to provide an improved atomization spray nozzle for use in a MHD process having preheating means to ensure that the nozzle is heated to a temperature compatible with the molten metal prior to atomization.

Another object of the present invention is to provide an improved atomization spray nozzle having a simplified construction to facilitate attachment to the tundish of a MHD spray forming system.

Another object of the present invention is to provide an improved spray nozzle capable of containing molten metal as it is transferred from the tundish to the atomization inlet.

Yet another object of the present invention is to provide an improved atomization spray nozzle having a direct hydraulic coupling to the tundish in order to contain molten metal being atomized and to automatically meter molten metal from the tundish.

Still another object of the present invention is to provide an improved atomization spray nozzle having a compact size and simple construction which facilities the use of external thermal insulation to be used to protect external ancillary components without degradation of their performance.

These and other objects are met by providing a nozzle for spray forming molten metal including a housing, a molten metal feed passage having a first end connectable to a tundish for containing molten metal and a second end, and electrode means, disposed at least partially in the feed passage at the second end, for passing a D.C. electric current through the molten metal while the molten metal is simultaneously subjected to a magnetic field oriented at an angle perpendicular to the electric current.

In another aspect of the present invention, a magnetohydrodynamic atomization system comprises a tundish for containing a quantity of molten metal, a nozzle including a housing, a molten metal feed passage having a first end and a second end and electrode means disposed at least partially in the feed passage at the second end, for passing a D.C. electric current through the molten metal, means for subjecting the molten metal to a magnetic field oriented at an angle perpendicular to the electric current, and conduit means for communicating molten metal from the tundish to the first end of the feed passage.

DETAILED DESCRIPTION OF THE PREFERRED EMBODIMENTS

Figure 1:
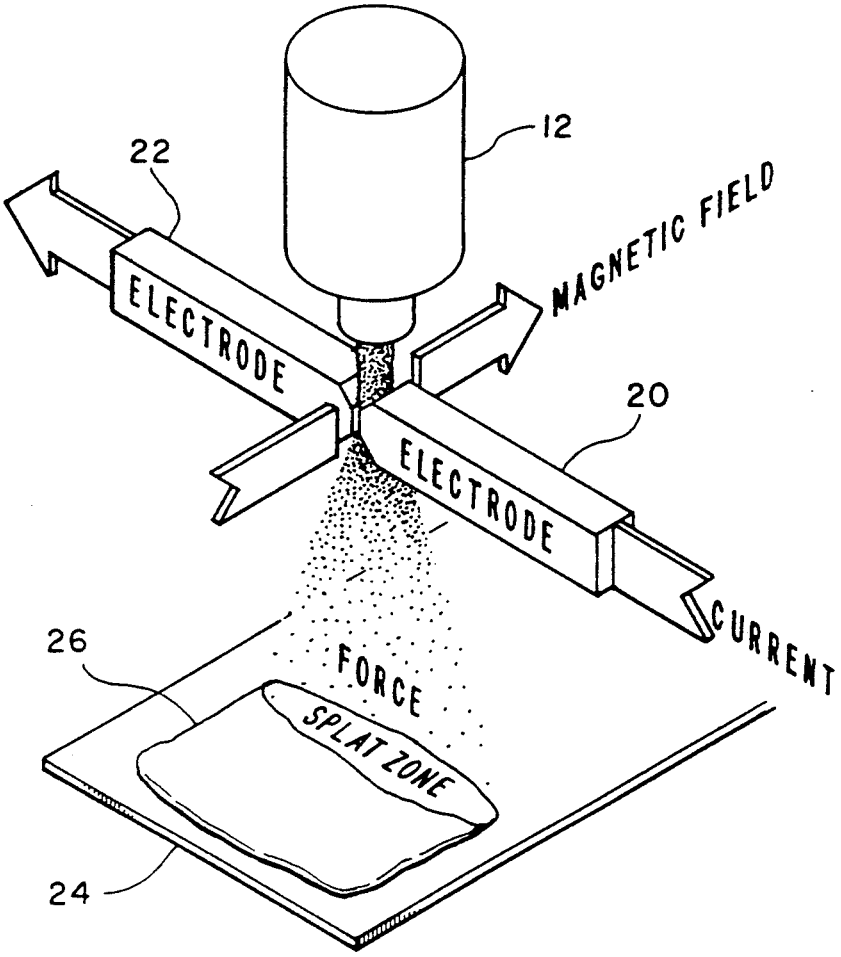
FIG. 1 is a schematic view showing atomization of molten metal using MHD generated forces according to the present invention.
Figure 2:
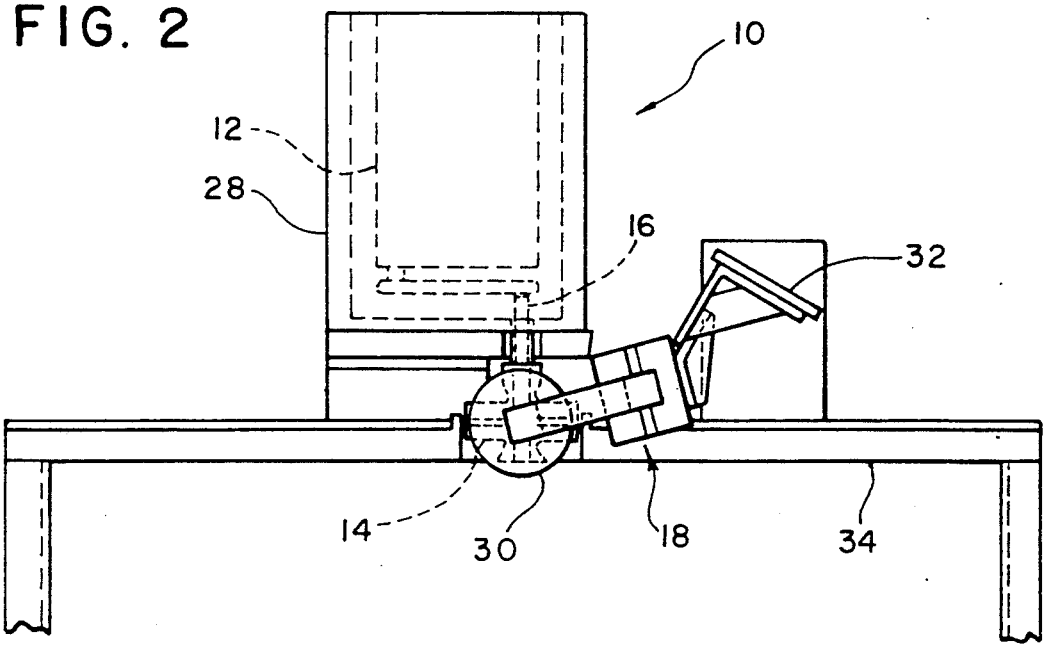
FIG. 2 is a schematic side elevational view of a MHD atomization apparatus according to the present invention.

Referring to FIGS. 1 and 2 a MHD atomization apparatus 10 includes a tundish 12 for containing a quantity of molten metal, a nozzle 14 for metering and spraying the molten metal, a conduit 16 for communicating molten metal from the tundish 12 to the nozzle 14, and an electromagnet 18 for subjecting the molten metal to a magnetic field oriented at an angle perpendicular to an electric current passing through the molten metal in the nozzle 14. The nozzle 14 establishes a pressure gradient by the generation of a Lorentz body force on the molten metal. This body force can be seen schematically in FIG. 1 where orthogonal fluxes of electric current and magnetic field are simultaneously applied to the stream of molten metal fed between electrode 20 and 22 of the nozzle 14. (The nozzle body is not illustrated in FIG. 1 in order to illustrate electrical and magnetic flux.) By properly shaping the two electrodes 20 and 22, the flow is both pulled through the nozzle gap and simultaneously forced against the faces of the nozzle electrodes 20 and 22. This causes the jet to continuously decrease in thickness at it passes through the spray electrodes, so as to eventually break up into a fan-shape spray of small droplets. A translating table (not shown) can be used to move a cooled substrate 24 under the spray discharge to form a solidified metal slab 26, for example. Other spraying operations may be performed to produce rear-net-shape parts such as bars, pipes, etc., or to produce metal-matrix composites, or to simply spray coat an object. The entire MHD apparatus may be housed in a pressure vessel (not shown).

The molten metal may be delivered to the tundish 12 in molten form from an induction-heater (not shown) located outside the pressure vessel but in communication with the tundish 12. A resistive heater enclosure 28, as seen in FIG. 2, preheats the tundish 12 to a temperature of 1,250–1,300° C, using a 10 KW power source.

The conduit 16 is a short pipe nipple disposed partially inside the tundish heater enclosure 28, so as to keep the steel or other metal molten during transfer from the tundish 12 to the spray nozzle 14. The spray nozzle is coupled directly to the conduit 16, as seen in FIG. 2.

The electrodes 20 and 22, shown schematically in FIG. 1, are coupled to a power source (not shown) such as 1500A 10 VDC power supply to produce a current flow through the molten metal. The molten metal bridges a gap, known as the "throat", between the electrodes, as will be described in greater detail below. The electromagnet 18 is powered by a power source (not shown) which delivers, for example, 1,000A 10 VDC current to induction coils, a plane of which is projected against the face of the spray nozzle 14 as a circle 30. The electromagnet 18 is supported by a series of adjustable brackets 32 on a frame 34 which also support the nozzle 14 and tundish 12. The brackets 32 can be adjusted for relative positioning of the electromagnet 18 and nozzle 14 in three dimensions over a range of about ±50 m.m., for example.

In the embodiment illustrated in FIG. 1, where a moving substrate is disposed under the nozzle 14 to produce a metal sheet or slab, a substrate translating mechanism (not shown) can be located about 600 m.m. below the discharge of the nozzle 14. Speed and direction of movement can be controlled manually or with a programmable logic controller.

Figure 3:
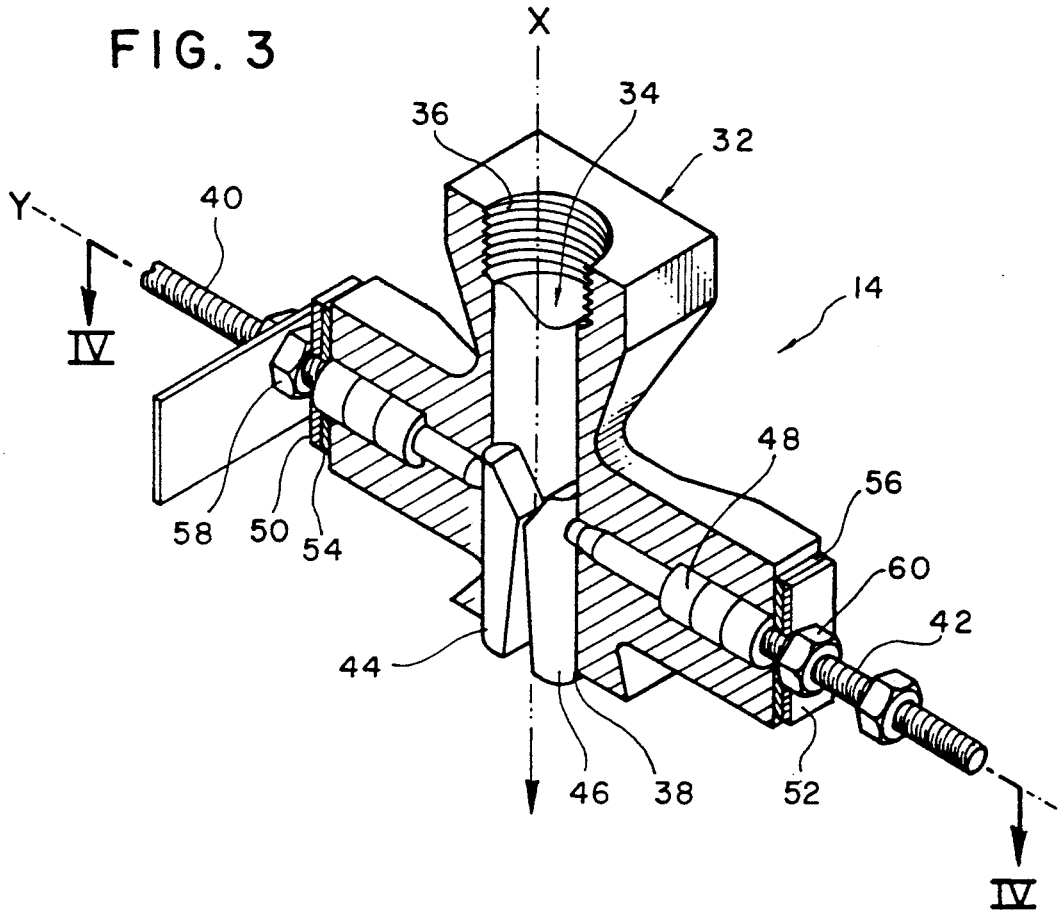
FIG. 3 is a perspective view, partially in vertical section, of an atomization nozzle according to the present invention.
Figure 4:
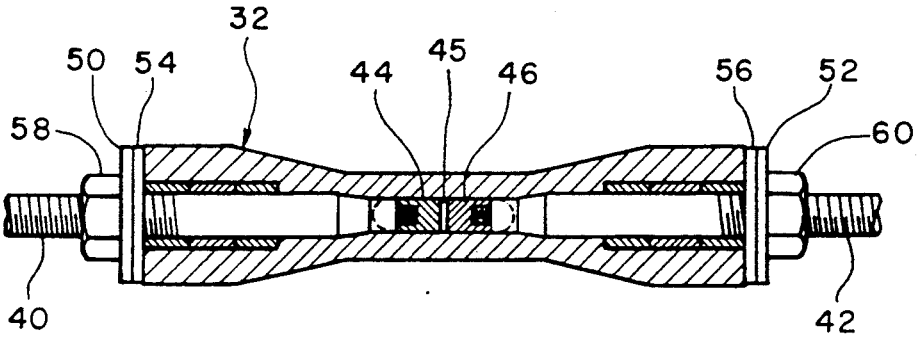
FIG. 4 is an enlarged horizontal sectional view taken in the plane of line IV—IV of FIG. 3 at the electrode throat.

Referring now to FIG. 3 and 4, the nozzle 14 includes a housing 32 having a generally inverted T-shape with two principal orthogonal axes, X and Y. A molten metal feed passage 34 extends through the housing 32 and is centered on the X axis and has a first end 36 and a second end 38. The first end 36 is threaded to couple the housing 32 to the tundish 12 as seen in FIG. 2, through the conduit 16 which has a correspondingly threaded end.

A bore is provided in the housing 32 along the Y axis to receive feed through electrodes 40 and 42, inner ends of which are respectively coupled to spray electrodes 44 and 46 disposed at least partially in the feed passage 34. Collectively, electrodes 40 and 44 correspond to electrode 22 of FIG. 1, and electrodes 42 and 46 correspond to electrode 20. The spray electrodes 44 and 46 are spaced apart to define a nozzle throat 45, as seen in FIG. 4, which is the minimum distance between the two electrodes. When molten metal passes through the throat 45, an electrical current path is formed so that current flows through the molten metal. The spray electrodes 44 and 46 have a specific shape designed to maximize atomization conditions, as will be explained more fully below.

A plurality of bushing insulators 48 are disposed in the housing 32 along the Y axis towards the outer portion of the housing. In a preferred embodiment, the housing 32 is made of graphite, the spray electrodes 40 and 42 are made of Niobium (Nb) alloy (such as TRIDOCOR, a Nb-30Ti-20W alloy, and a trade name of Fansteel Inc.); and the feed through electrodes 40 and 42 are made of tantalum (Ta) alloy. Resistance to corrosion of the graphite housing may be enhanced by coating with a $Y_2O_3$ or $ZrO_3$ wash. The spray electrodes 40 and 42 may be nitrided in a vacuum at 1600° C. for about 135 minutes prior to use to give a deposition of about 10 mg/cm$^2$ of titanium nitride layer. This provides excellent wetting in contact with steel, good electrical conductivity, and excellent corrosion resistance. Bushing insulators 48 are preferably made of $Al_2O_3$. While the housing 32 is shaped to channel and meter the molten metal into the region of the spray electrodes 44 and 46, the graphite material of the housing serves another purpose. In particular, when the molten metal is not in the assembly, and d.c. power is supplied to the electrodes, the current flows through the electrodes 40, 42, into the spray electrodes 44, 46, and into the graphite housing passing through a thinned cross section of the housing. By design, the graphite housing is made to act as a resistive heater.

The result is a controllable resistive heating in the assembly before the molten metal is introduced. Preheating in this manner will prevent freezing of molten metal being atomized as it passes through the nozzle.

When molten metal passes through the feed passage 34, an electric current path is formed by the molten metal bridging the throat 45 between the spray electrodes 40 and 42. The resistance path of this newly formed circuit is much less than the preheating circuit. Thus, most current is redirected into the spray electrodes 44 and 46 to accomplish atomization by the resulting MHD forces generated by the electrode current and the externally applied magnetic field generated by the electromagnet 18.

Figure 5:
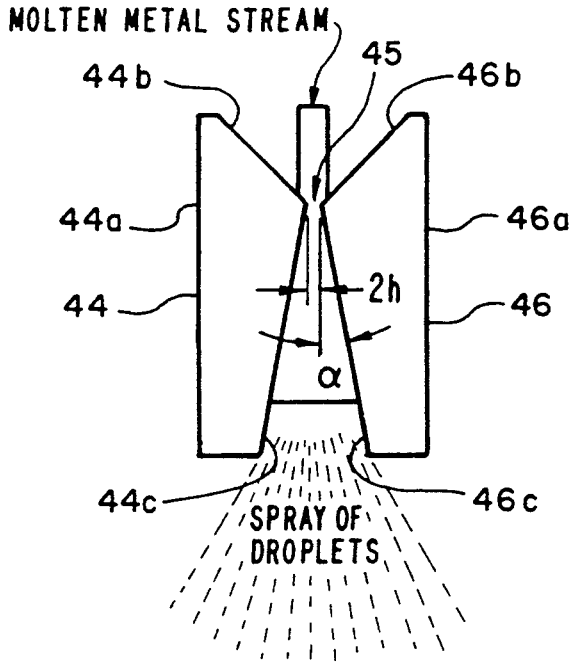
FIG. 5 is an enlarged side elevational view showing the geometry of the two electrodes used in the nozzle of the present invention.

As seen in FIG. 5, the spray electrodes 44 and 46 have flat surfaces **44*a* and 46*a* which are held tightly against corresponding surfaces in the feed passage. Converging surfaces 44*b* and 46*b* form a 90° angle above the throat 45, while diverging surfaces 44c and 46c form an acute angle o of preferably 15°. The angles above and below the throat 45**, as well as the width of the throat (which in the illustrated embodiment is about 0.63 m.m.) are selected to provide a desired particle size and spray uniformity, while at the same time avoiding the tendency to arc at larger divergent angles.

As seen in FIG. 3, graphite spring washers 50 and 52 are disposed at ends of the housing 32 and bear against $Al_2O_3$ insulating washers 54 and 56, respectively. The outer portions of the feed through electrodes 40 and 42 are threaded to engage tightening nuts 58 and 60. The spring washers 50 and 52 tightly pull the spray electrodes against the surfaces of the feed passage 34 to avoid high electrical contact resistance at all mechanical interfaces. High contact resistance limits current density in the nozzle and generates localized hot spots. At room temperature, the nuts 58 and 60 are tightened in order to compress the graphite spring washers. In use, when molten metal at up to 1600° C. enters the passage 34, the feed through electrodes 40 and 42 lengthen about 0.25 m.m. relative to the graphite housing they bear against. The graphite washers 58 and 60 compensate for this thermal expansion by providing about 0.4 m.m. of travel and a clamping force of about 67N when the assembly is at 1600° C. Thus, sufficient electrical contact pressures at operating temperature are maintained.

Figure 6:
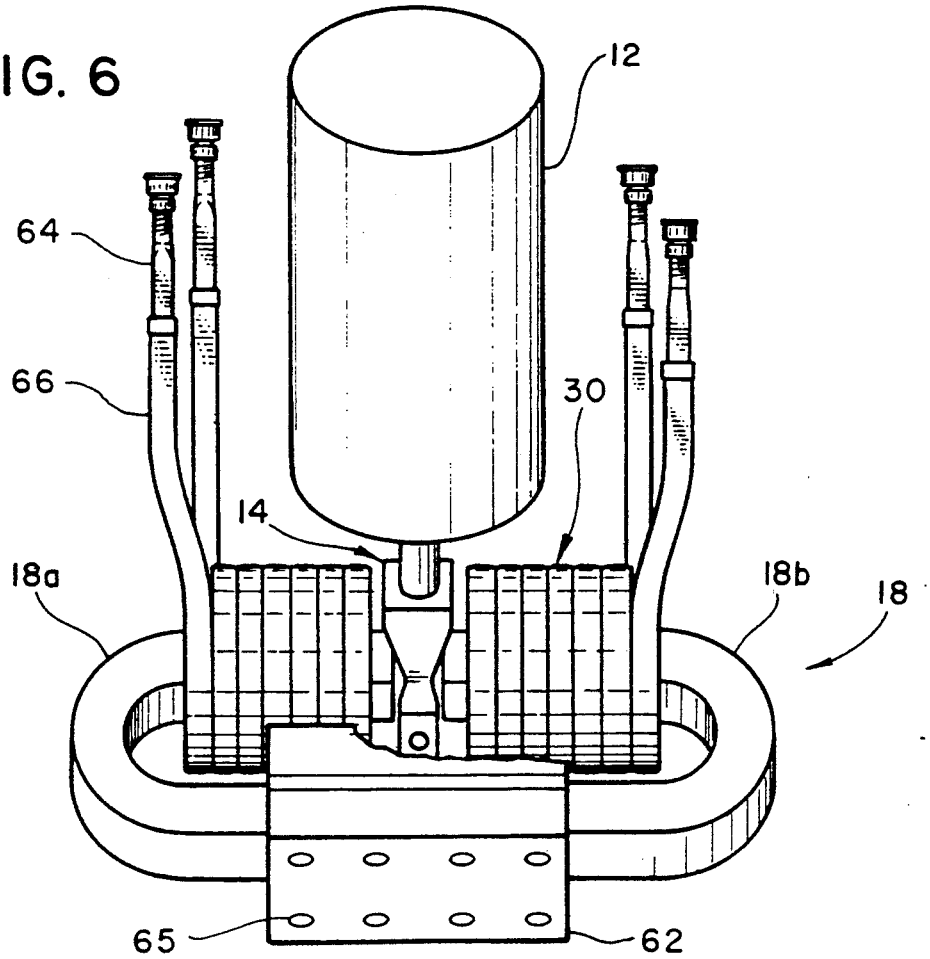
FIG. 6 is a partial assembly of a MHD apparatus of the present invention showing the nozzle, electromagnet and tundish.

A preferred version of the electromagnet 18 is illustrated in FIG. 6. As an example, the induction coil 30 may have 48 turns by wrapping six turns long by four turns high on each magnet pole 18a and 18b. A pinch block 62 allows the yoke of the electromagnet to have an adjustable-length air gap to accommodate various spray nozzle designs. Screws 65 are loosened so that the two halves of the yoke can be slideably adjusted between upper and lower halves of the pinch block 62. The yoke is preferably made of a high magnetic permeability CoFe alloy in order to maximize its saturation inductance and ultimately the flux density in the air gap. The curie point of the yoke CoFe alloy material is about 850° C., and thus, cooling means should be provided when atomizing steel at 1600° C. One way to accomplish this is to heavily insulate the nozzle 14 in the air gap. However, when operating for prolonged periods of time, a heat sink may be required. As seen in FIG. 6, the heat sink may be a water cooled set of the induction coils. Copper tubing 64 is coiled around the induction coils 30. The tubing 64 may be 6.3 m.m. square copper tubing having a 3.2 m.m. inner diameter through which cooling water flows. The tubing 64 is electrically insulated by enclosing it in an alumina-borosilicate sleeving 66. Typically, the electromagnet 18 operates at a 300° C. magnet face temperature with the nozzle 14 inserted into a 13 m.m. air gap. In order to reduce the hydraulic pressure drop in the magnet cooling water, each coil is in parallel with the water supply line. Electrically, each coil is in series with a 10 VDC, 1500 A power supply (not shown).

The housing 32 of the nozzle 14 may be made of other materials, such as TRIDOCOR. Compared to graphite, the use of TRIDOCOR or other similar materials including boron nitride may prevent preheating through electrical resistance. Thus, additional preheating means may be employed, such as high temperature tape heaters attached to the housing 32.

It is believed that the presence of the Lorentz body forces in the streamwise direction change the characteristics of nozzle flow. In the region close to the nozzle throat 45, the streamwise velocity increases and the Lorentz force varies as the reciprocal of distance from the nozzle throat. Also, the Lorentz force prevents reverse flow in this region so that the flow resists separation.

For small angle nozzles, the velocity along the center line is accelerated according to $(\log r)^{\frac{1}{2}}$ and is proportional to $(BV/\alpha)^{\frac{1}{2}}$ where r = normalized radial coordinate
B = magnetic intensity
2V = voltage drop
$\alpha$ = nozzle semi-angle According to the aerodynamic instability analysis of an inviscid liquid sheet with diminishing thickness the average droplet size is proportionate to $(hBV)^{1/3}$, although the nozzle angle should have no effect on the mean droplet size. Generally, it was found that the included angle formed by the two diverging surfaces 44c and 46c, as seen in FIG. 5, can be an acute angle selected to provide the desired droplet size and flow rate.

While there has been shown and described what is at present considered the preferred embodiment of the invention, it will be obvious to those skilled in the art that various changes and modifications may be made therein without departing from the scope of the invention as defined by the appended claims

What is claimed is:

1. A nozzle for a magnetohydrodynamic atomization systems comprising:

a housing; a molten metal feed passage having a first end connectable to a tundish for containing molten metal and a second end; and electrode means, disposed at least partially in the feed passage at the second end, for passing a D.C. electric current through the molten metal while the molten metal is simultaneously subjected to a magnetic field oriented at an angle perpendicular to the electric current.

2. A nozzle according to claim 1, wherein the housing has a substantially inverted T-shape with two principle orthogonal axes, X and Y the feed passage being centered on the X axis and the electrode means being centered in the Y axis.

3. A nozzle according to claim 1, wherein the electrodes means comprises first and second feed through electrodes, each having an inner end extending into the feed passage and an outer end disposed outside the housing, and passing through the housing along the Y axis, and first and second spray electrodes coupled respectively to the inner ends of the first and second feed through electrodes and being disposed at least partially in the feed through passage, the first and second spray electrodes being spaced apart to define a nozzle throat in the feed passage.

4. A nozzle according to claim 3, wherein the housing is made of material having a higher electrical resistance than a material of which the feed through electrodes and the spray electrodes are made.

5. A nozzle according to claim 4, wherein the housing is made of graphite, the first and second spray electrodes, the first and second feed through electrodes, and the housing defining a current path for resistively heating the housing prior to introducing molten metal into the feed passage.

6. A nozzle according to claim 5, wherein the feed through electrodes are made of tantalum alloy and the spray electrodes are made of niobium alloy.

7. A nozzle according to claim 3, wherein the spray electrodes have complementary angled converging surfaces above the throat and complementary angled diverging surfaces below the throat.

8. A nozzle according to claim 7, wherein the diverging surfaces of the spray electrodes form an acute angle.

9. A nozzle according to claim 3, further comprising means for maintaining tight physical contact between the spray electrodes and the housing during thermal expansion of the feed through electrodes.

10. A nozzle according to claim 9, wherein the maintaining means comprises first and second spring washers disposed on opposite ends of the housing, the first and second feed through electrodes having threaded outer portions, and first and second threaded fasteners threadedly engaging respectively the first and second feed through electrodes.

11. A magnetohydrodynamic atomization system comprising:

a tundish for containing a quantity of molten metal;

a nozzle including a housing, a molten metal feed passage having a first open end and a second open end and electrode means disposed at least partially in the feed passage at the second end, for passing a D.C. electric current through the molten metal;

means for subjecting the molten metal to a magnetic field oriented at an angle perpendicular to the electric current; and conduit means for communicating molten metal from the tundish to the first end of the feed passage.

12. A magnethydrodynamic atomization system according to claim 11, wherein the housing has a substantially inverted T-shape with two principal orthogonal axes, X and Y, the feed passage being centered on the X axis and the electrode means being centered on the Y axis.

13. A magnethydrodynamic atomization system according to claim 11, wherein the electrodes means comprises first and second feed through electrodes, each having an inner end extending into the feed passage and an outer end disposed outside the housing, and passing through the housing along the Y axis, and first and second spray electrodes coupled respectively to the inner ends of the first and second feed through electrodes and being disposed at least partially in the feed through passage, the first and second spray electrodes being spaced apart to define a nozzle throat in the feed passage.

14. A magnethydrodynamic atomization system according to claim 13, wherein the housing is made of material having a higher electrical resistance than a material of which the feed through electrodes and the spray electrodes are made.

15. A magnethydrodynamic atomization system according to claim 14, wherein the housing is made of graphite, the first and second spray electrodes, the first and second feed through electrodes and the housing defining a current path for resistively heating the housing prior to introducing molten metal into the feed passage.

16. A magnethydrodynamic atomization system according to claim 15, wherein the feed through electrodes are made of tantalum alloy and the spray electrodes are made of niobium alloy.

17. A magnethydrodynamic atomization system according to claim 13, wherein the spray electrodes have complementary angled converging surfaces above the throat and complementary angled diverging surfaces below the throat.

18. A magnethydrodynamic atomization system according to claim 17, wherein the diverging surfaces of the spray electrodes form an acute angle.

19. A magnethydrodynamic atomization system according to claim 13, further comprising means for maintaining tight physical contact between spray electrodes and the housing during thermal expansion of the feed through electrodes.

20. A magnethydrodynamic atomization system according to claim 19, wherein the maintaining means comprises first and second spring washers disposed on opposite ends of the housing, the first and second feed through electrodes having threaded outer portions, and first and second threaded fasteners threadedly engaging respectively the first and second feed through electrodes.

* * * * *